US009380660B2

(12) United States Patent
Hiramatu et al.

(10) Patent No.: US 9,380,660 B2
(45) Date of Patent: Jun. 28, 2016

(54) ELECTRONIC BALLAST AND LUMINAIRE WITH THE SAME

(71) Applicant: Panasonic Corporation, Osaka (JP)

(72) Inventors: Akinori Hiramatu, Nara (JP); Daisuke Yamahara, Osaka (JP); Shigeru Ido, Osaka (JP); Junichi Hasegawa, Osaka (JP); Takeshi Kamoi, Kyoto (JP); Hiroshi Kido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/451,588

(22) Filed: Aug. 5, 2014

(65) Prior Publication Data

US 2015/0042228 A1 Feb. 12, 2015

(30) Foreign Application Priority Data

Aug. 7, 2013 (JP) ..... 2013-164306
Aug. 7, 2013 (JP) ..... 2013-164307

(51) Int. Cl.

| | |
|---|---|
| ***H05B 33/08*** | (2006.01) |
| ***F21V 29/00*** | (2015.01) |
| *F21S 8/02* | (2006.01) |
| *F21V 23/02* | (2006.01) |
| *F21V 23/04* | (2006.01) |
| *F21Y 101/02* | (2006.01) |
| *F21V 29/70* | (2015.01) |

(52) U.S. Cl.

CPC ..... *H05B 33/0815* (2013.01); *F21S 8/026* (2013.01); *F21V 23/02* (2013.01); *F21V 23/04* (2013.01); *F21V 29/70* (2015.01); *F21Y 2101/02* (2013.01)

(58) Field of Classification Search

None

See application file for complete search history.

(56) References Cited

U.S. PATENT DOCUMENTS 4,751,398 A * 6/1988 Ertz, III ..... H02J 9/065 307/44
5,068,578 A * 11/1991 Wegener ..... B23K 11/241 315/291
5,142,203 A * 8/1992 Oda ..... H05B 41/2882 315/224

(Continued)

FOREIGN PATENT DOCUMENTS

JP 2002-525814 A 8/2002
JP 2006-147373 A 6/2006

(Continued)

OTHER PUBLICATIONS

Chinese Office Action issued Feb. 1, 2016 for corresponding Chinese Application No. 201410386843.X. English language translation.

*Primary Examiner* — Crystal L Hammond
(74) *Attorney, Agent, or Firm* — Renner, Otto, Boisselle & Sklar LLP.

(57) ABSTRACT

An electronic ballast includes an AC-DC converter, a DC-DC converter, a cooling device and a power supply. The cooling device is configured to cool the light source. The power supply includes a first power supply configured to generate a first operating voltage from a first voltage obtained from a chopper circuit included in the AC-DC converter to supply the first operating voltage to at least one of the AC-DC converter and the DC-DC converter. The power supply further includes a second power supply configured to generate a second operating voltage from a second voltage obtained from the chopper circuit to supply the second operating voltage to at least the cooling device of the AC-DC converter, the DC-DC converter and the cooling device.

4 Claims, 6 Drawing Sheets

(56) References Cited

U.S. PATENT DOCUMENTS

| | | | | |
|---|---|---|---|---|
| 6,107,754 | A * | 8/2000 | Kim | H02M 7/53803 315/209 R |
| 6,181,084 | B1 * | 1/2001 | Lau | H05B 41/2881 315/291 |
| 2003/0222595 | A1 * | 12/2003 | Chen | H05B 41/2885 315/291 |
| 2003/0222605 | A1 * | 12/2003 | Okamoto | H05B 41/2928 315/308 |
| 2005/0093479 | A1 * | 5/2005 | Deurloo | H05B 41/2885 315/247 |
| 2007/0164687 | A1 * | 7/2007 | Watanabe | H04N 9/3114 315/291 |
| 2009/0289557 | A1 * | 11/2009 | Itoh | H05B 41/2882 315/127 |
| 2010/0289418 | A1 * | 11/2010 | Langovsky | H05B 33/0809 315/210 |
| 2011/0074310 | A1 * | 3/2011 | Nakada | H05B 41/2886 315/291 |
| 2012/0001563 | A1 * | 1/2012 | Rimmer | H05B 33/0803 315/256 |
| 2012/0146525 | A1 * | 6/2012 | Hui | H05B 33/0809 315/200 R |
| 2012/0153863 | A1 | 6/2012 | Hamamoto et al. | |
| 2013/0038242 | A1 * | 2/2013 | Athalye | H05B 33/0815 315/297 |

FOREIGN PATENT DOCUMENTS

| | | | |
|---|---|---|---|
| JP | 2008-198478 | A | 8/2008 |
| JP | 2010-192406 | A | 9/2010 |
| JP | 2011-150936 | A | 8/2011 |
| JP | 2012-133942 | A | 7/2012 |
| TW | 200746919 | A | 12/2007 |
| WO | WO 00/17569 | A1 | 3/2000 |

* cited by examiner 1
1a
1b
2
FILTER
VAC
3
18
181
182
183
184
28
8
L1
L2
D1
D2
Q1
C1
ZD1
C2
5
FIRST CONTROL CIRCUIT
7
FIRST POWER SUPPLY
V11
V12
V13
9
THIRD POWER SUPPLY
MAIN CONTROLLER
11
17
1A
4
41
T1
L3
L4
D3
C3
Q2
V1
V2
SECOND CONTROL CIRCUIT
6
10
16a
16b
20
21
15
13
14
12
13a
13b 1
1a
1b
2
FILTER
VAC
3
18
183
181
182
184
28
L1
L2
8
D2
ZD1
C2
D1
C1
Q1
V12
V1
4
41
T1
L3
L4
D3
C3
Q2
V2
16a
16b
10
20
21
15
13
14
12
13a
13b
SECOND CONTROL CIRCUIT
6
FIRST CONTROL CIRCUIT
5
FIRST POWER SUPPLY
7
V11
THIRD POWER SUPPLY
9
V13
MAIN CONTROLLER
11
1A
17

ELECTRONIC BALLAST AND LUMINAIRE WITH THE SAME

CROSS-REFERENCE TO RELATED APPLICATIONS

This application claims the benefit and priority of Japanese Patent Application No. 2013-164306, filed on Aug. 7, 2013, entitled "ELECTRONIC BALLAST AND LUMINAIRE WITH THE SAME", and Japanese Patent Application No. 2013-164307, filed on Aug. 7, 2013, entitled "ELECTRONIC BALLAST AND LUMINAIRE WITH THE SAME", the entire contents of which are incorporated herein by reference.

TECHNICAL FIELD

This disclosure relates generally to electronic ballasts and luminaires and, more particularly, to an electronic ballast (a lighting device) for a light source that includes at least a solid-state light-emitting device, and a luminaire with the same.

BACKGROUND ART

Light emitting modules with LEDs (light-emitting diodes) have been provided as a light source for a luminaire in recent years.

In general, a light emitting module has a tendency to decrease an output of the light emitting module and shorten useful life of the light emitting module as a result of rise in LEDs' temperature. It is therefore important to prevent LEDs' temperature from rising in order to prolong the useful life of the light emitting module in a luminaire with the light emitting module. A luminaire with a light emitting module including LEDs to be driven with high-power requires further preventing LEDs' temperature from rising.

For example, JP Pub. No. 2011-150936 (hereinafter referred to as "Document 1") discloses an LED lighting device having a cooling means such as a fan, and a lighting device.

The LED lighting device described in Document 1 includes LED series circuits and a cooling means driver. The series circuits are connected between output terminals of a DC power supply. The cooling means driver is connected between both ends of a part of the series circuits, including at least one or more LEDs, and configured to cool heat generated by the LEDs. The LED lighting device can effectively prevent its own LEDs' temperature from rising.

A stable voltage can be secured without specially providing the cooling means driver with a power supply. In a case where a fan is employed as a cooling means, the cooling means driver is to drive a fan motor. In this case, the cooling means driver requires a DC voltage of about 6V as DC power for driving the fan motor, and is accordingly supplied with a sum of forward voltages of two LEDs in the series circuit, namely a stable DC voltage of about 6V.

In the LED lighting device of Document D1, there is however difficulty in further preventing LEDs' temperature from rising because only a DC voltage of about 6V is supplied to the fan motor of the cooling means driver.

SUMMARY OF THE INVENTION

It is an object of the present invention to provide an electronic ballast (an LED ballast) capable of supplying a stable voltage to a cooling device and further preventing light source's temperature from rising, and a luminaire with the same.

According to an aspect of the present invention, an electronic ballast (10) comprises an AC-DC converter (3), a DC-DC converter (4), a cooling device (12) and a power supply (1A). The AC-DC converter (3) comprises a chopper circuit (28) configured to convert an AC voltage ($V_{AC}$) from a commercial power supply (1) into a first DC voltage (V1). The DC-DC converter (4) comprises a DC-DC conversion circuit (41) configured to convert the first DC voltage (V1) into a second DC voltage (V2) to supply the second DC voltage (V2) to a light source (20) including at least a solid-state light-emitting device (21). The cooling device (12) is configured to cool the light source (20). The power supply (1A) comprises a first power supply (7) and a second power supply (8). The first power supply (7) is configured to generate a first operating voltage (V11) from a first voltage obtained from the chopper circuit (28) to supply the first operating voltage (V11) to at least one of the AC-DC converter (3) and the DC-DC converter (4). The second power supply (8) is configured to generate a second operating voltage (V12) from a second voltage obtained from the chopper circuit (28) to supply the second operating voltage (V12) to at least the cooling device (12) of the AC-DC converter (3), the DC-DC converter (4) and the cooling device (12).

According to an aspect of the present invention, a luminaire comprises a light source (20) including at least a solid-state light-emitting device (21); and an electronic ballast (10). The electronic ballast (10) comprises an AC-DC converter (3), a DC-DC converter (4), a cooling device (12) and a power supply (1A). The AC-DC converter (3) comprises a chopper circuit (28) configured to convert an AC voltage ($V_{AC}$) from a commercial power supply (1) into a first DC voltage (V1). The DC-DC converter (4) comprises a DC-DC conversion circuit (41) configured to convert the first DC voltage (V1) into a second DC voltage (V2) to supply the second DC voltage (V2) to the light source (20). The cooling device (12) is configured to cool the light source (20). The power supply (1A) comprises a first power supply (7) and a second power supply (8). The first power supply (7) is configured to generate a first operating voltage (V11) from a first voltage obtained from the chopper circuit (28) to supply the first operating voltage (V11) to at least one of the AC-DC converter (3) and the DC-DC converter (4). The second power supply (8) is configured to generate a second operating voltage (V12) from a second voltage obtained from the chopper circuit (28) to supply the second operating voltage (V12) to at least the cooling device (12) of the AC-DC converter (3), the DC-DC converter (4) and the cooling device (12).

In the present invention, it is possible to supply a stable voltage to a cooling device and further prevent light source's temperature from rising.

BRIEF DESCRIPTION OF THE DRAWINGS

The figures depict one or more implementations in accordance with the present teaching, by way of example only, not bay way of limitations. In the figure, like reference numerals refer to the same or similar elements where.

DETAILED DESCRIPTION

An electronic ballast (an LED ballast) 10 in accordance with an embodiment of the present invention is now explained with reference to FIGS. 1 to 3. For example, the electronic ballast 10 is configured to operate a light source 20 including one or more solid-state light-emitting devices 21. In the embodiment, the light source 20 includes solid-state light-emitting devices 21.

Figure 1:
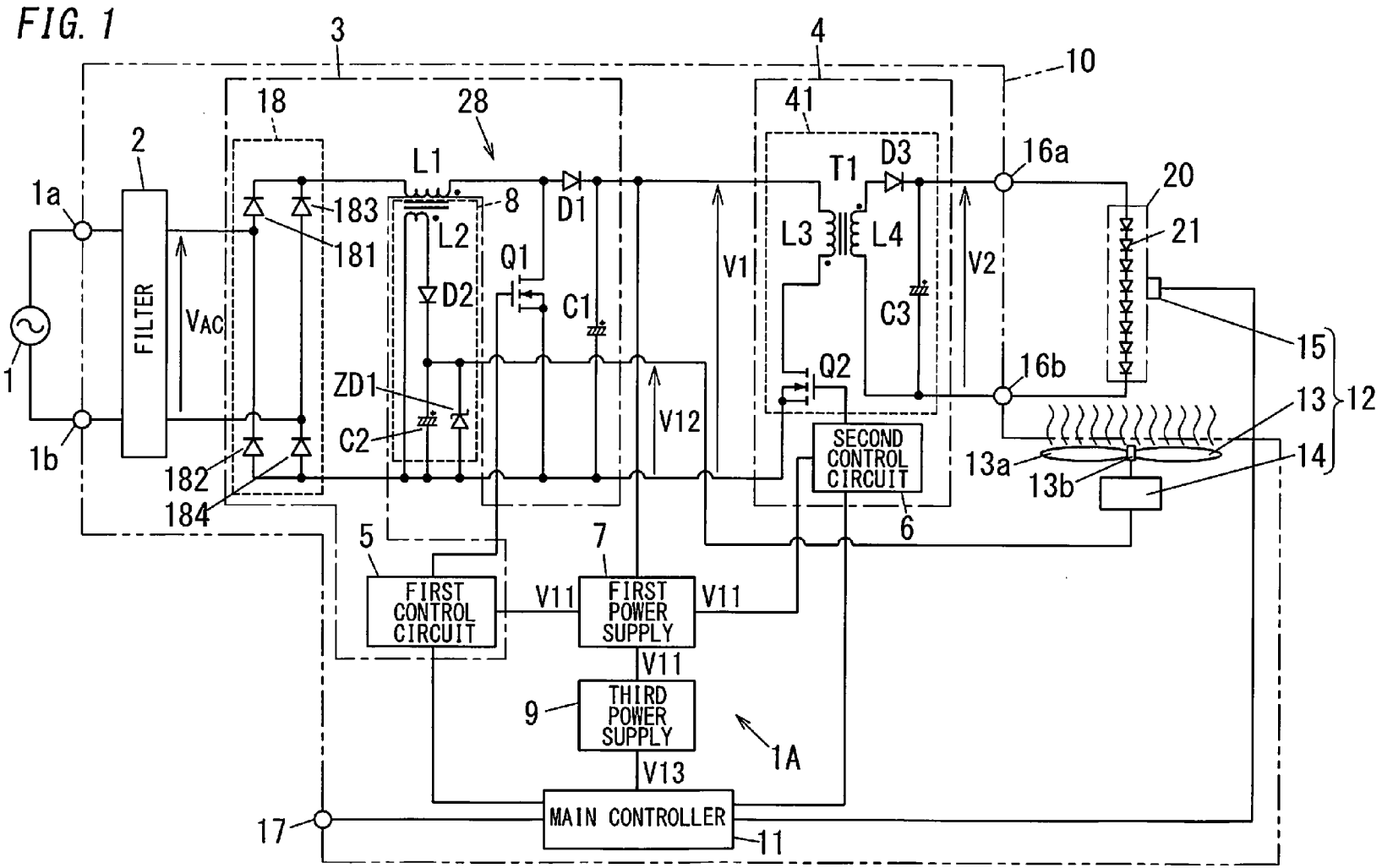
FIG. 1 exemplifies a schematic circuit diagram of an electronic ballast in accordance with an embodiment of the present invention.

In an example of FIG. 1, the light source 20 has eight solid-state light-emitting devices 21. In the embodiment, light-emitting diodes (LEDs) are employed as the solid-state light-emitting devices 21, and light emission color thereof is set to white. In the example of FIG. 1, a connection configuration of the solid-state light-emitting devices 21 is a series connection, but the invention is not limited to this. As an embodiment of the invention, the connection configuration may be a parallel connection or a combination of a series connection and a parallel connection.

The electronic ballast 10 includes a filter 2, an AC-DC converter 3, a DC-DC converter 4, a power supply 1A, a cooling device 12 and a main controller 11. The filter 2 is configured to remove noise (e.g., noise from and/or to a commercial power supply 1).

The AC-DC converter 3 includes a chopper circuit 28 that is configured to convert an AC (alternating current) voltage $V_{AC}$ from the commercial power supply 1 into a first DC (direct current) voltage V1. In the example of FIG. 1, the AC-DC converter 3 includes a full-wave rectifier 18 and a first control circuit 5 in addition to the chopper circuit 28.

The DC-DC converter 4 includes a DC-DC conversion circuit 41 that is configured to convert the first DC voltage V1 into a second DC voltage V2 to supply the second DC voltage V2 to the light source 20. In the example of FIG. 1, the DC-DC converter 4 includes a second control circuit 6 in addition to the DC-DC conversion circuit 41.

In the embodiment, the first DC voltage V1 and the second DC voltage V2 are set to, for example, 410V and 150V, respectively.

The first control circuit 5 is configured to control the chopper circuit 28 of the AC-DC converter 3. The second control circuit 6 is configured to control the DC-DC conversion circuit 41 of the DC-DC converter 4.

The power supply 1A includes a first power supply 7 and a second power supply 8. The first power supply 7 is configured to generate a first operating voltage V11 from a first voltage obtained from the chopper circuit 28 to supply the first operating voltage V11 to at least one of the AC-DC converter 3 and the DC-DC converter 4. The second power supply 8 is configured to generate a second operating voltage V12 from a second voltage obtained from the chopper circuit 28 to supply the second operating voltage V12 to at least the cooling device 12 of the AC-DC converter 3, the DC-DC converter 4 and the cooling device 12.

In the example of FIG. 1, the first power supply 7 is configured to supply the first operating voltage V11 to the AC-DC converter 3 and the DC-DC converter 4. Specifically, the first power supply 7 is configured to generate the first operating voltage V11 for the first control circuit 5 and the second control circuit 6 from the first voltage to supply the first operating voltage V11 to the first control circuit 5 and the second control circuit 6, where the first voltage is the first DC voltage V1. In the embodiment, the first operating voltage V11 is set to, for example, 12V. The second power supply 8 is configured to generate the second operating voltage V12 for the cooling device 12 from the second voltage to supply the second operating voltage V12 to the cooling device 12.

In the example of FIG. 1, the power supply 1A further includes a third power supply 9. The third power supply 9 is configured to generate a third operating voltage V13 for the main controller 11 from an output of the first power supply 7 (the first operating voltage V11) to supply the third operating voltage V13 to the main controller 11. In the embodiment, the third operating voltage V13 is set to, for example, a voltage in a range of 3-5V.

The cooling device 12 is configured to cool the light source 20 to be connected to an output side of the DC-DC converter 4. In the example of FIG. 1, the cooling device 12 is formed of a rotor (an impeller) 13, a driver 14 and a temperature sensor 15.

The main controller 11 is configured to individually control the first control circuit 5 and the second control circuit 6.

The electronic ballast 10 also includes a pair of power input terminals 1*a* and 1*b*, first and second power output terminals 16*a* and 16*b*, and a signal input terminal 17 configured to receive a signal from an outside (a dimming signal). In the example of FIG. 1, the first power output terminal 16*a* and the second power output terminal 16*b* are a positive output terminal and a negative output terminal, respectively.

Hereinafter, each component of the electronic ballast 10 is explained in details.

The filter 2 may be formed of, for example, a filter circuit including a common mode filter formed of at least one capacitor (not shown) and first and second inductors (not shown). For example, a first end of the first inductor is connected to a side of the power input terminal 1*a*, and a first end of the second inductor is connected to a side of the power input terminal 1*b*. The capacitor is connected between the first ends or second ends of the first and second inductors. In this case, the first ends of the first and second inductors constitute a pair of input ends of the filter 2, and the second ends of the first and second inductors constitute a pair of output ends of the filter 2.

The pair of input ends of the filter 2 is electrically connected to the commercial power supply 1 through the pair of power input terminals 1*a* and 1*b*. In the example of FIG. 1, the pair of input ends of the filter 2 is individually connected to the pair of power input terminals 1*a* and 1*b*, and the commercial power supply 1 is connected between the pair of power input terminals 1*a* and 1*b*. In the embodiment, a switch (not shown) configured to make or break an electrical connection between the commercial power supply 1 and the electronic ballast 10 is provided along a power supply line between the commercial power supply 1 and one of the pair of power input terminals 1*a* and 1*b*. In this case, the commercial power supply 1 is not included in a component of the electronic ballast 10.

For example, a diode bridge may be employed as the full-wave rectifier 18 of the AC-DC converter 3. In the example of FIG. 1, diodes 181 to 184 constitute the diode bridge. Specifically, a first end of the diode 181 and a first end of the diode 183 are connected and constitute a positive output end of the full-wave rectifier 18. A second end of the diode 181 and a first end of the diode 182 are connected and constitute an input end of the full-wave rectifier 18. A second end of the diode 183 and a first end of the diode 184 are connected and constitute another input end of the full-wave rectifier 18. A second end of the diode 182 and a second end of the diode 184 are connected and constitute a negative output end of the full-wave rectifier 18. In this example, each first end of the diodes 181 to 184 is a cathode, and each second end is an anode. In short, the full-wave rectifier 18 has a pair of input ends, and the positive and negative output ends. The pair of input ends of the full-wave rectifier 18 is individually connected to the pair of output ends of the filter 2.

For example, a boost chopper circuit (a boost converter) may be employed as the chopper circuit 28. The chopper circuit 28 includes a switching device Q1 and is configured so that the switching device Q1 is turned on and off in accordance with control (a control signal) of the first control circuit 5 and thereby an AC voltage from the commercial power supply 1 is increased to the first DC voltage V1.

In the example of FIG. 1, the chopper circuit 28 includes an inductor L1, a diode D1 and a capacitor C1 in addition to the switching device Q1. The inductor L1 is formed of a choke coil for chopper.

A first end of the inductor L1 is connected to the positive output end of the full-wave rectifier 18. A second end of the inductor L1 is connected to an anode side of the diode D1. A cathode of the diode D1 is connected to a positive side (i.e., a positive electrode side) of the capacitor C1. A negative side (i.e., a negative electrode side) of the capacitor C1 is connected to the negative output end of the full-wave rectifier 18. Both ends of the capacitor C1 constitute output ends of the AC-DC converter 3.

For example, an N-channel MOSFET that is normally off may be employed as the switching device Q1. A first end of the switching device Q1 (a drain terminal in the example of FIG. 1) is connected to the anode side of the diode D1. A second end of the switching device Q1 (a source terminal in the example) is connected to the negative side of the capacitor C1. A control terminal of the switching device Q1 (a gate terminal in the example) is connected to the first control circuit 5.

The second power supply 8 includes an inductor L2 as a secondary winding magnetically coupled to the inductor L1 as a primary winding in the chopper circuit 28, and the aforementioned second voltage is obtained from the inductor L2.

In the example of FIG. 1, the second power supply 8 includes a diode D2, a capacitor C2 and a Zener diode ZD1 in addition to the inductor L2. A first end of the inductor L2 is connected to the negative output end of the full-wave rectifier 18. A second end of the inductor L2 is connected to an anode side of the diode D2. A cathode of the diode D2 is connected to a positive side of the capacitor C2. A negative side of the capacitor C2 is connected to the negative output end of the full-wave rectifier 18. The Zener diode ZD1 is provided between both ends of the capacitor C2. A cathode of the Zener diode ZD1 is connected to the positive side of the capacitor C2. An anode of the Zener diode ZD1 is connected to the negative side of the capacitor C2.

For example, a flyback converter may be employed as the DC-DC converter 4. The DC-DC conversion circuit 41 of the DC-DC converter 4 includes a switching device Q2 and is configured so that the switching device Q2 is turned on and off in accordance with control (a control signal) of the second control circuit 6 and thereby an output (the first DC voltage V1) of the AC-DC converter 3 is decreased to the second DC voltage V2.

In the example of FIG. 1, the DC-DC conversion circuit 41 includes a transformer T1, a diode D3 and a capacitor C3 in addition to the switching device Q2. For example, an N-channel MOSFET that is normally off may be employed as the switching device Q2. The transformer T1 includes an inductor L3 as a primary winding and an inductor L4 as a secondary winding.

A first end of the inductor L3 in the transformer T1 is connected to a side of the positive output end of the AC-DC converter 3, namely the positive side of the capacitor C1. A second end of the inductor L3 is connected to a first end of the switching device Q2 (a drain terminal in the example of FIG. 1). A second end of the switching device Q2 (a source terminal in the example) is connected to a side of the negative output end of the AC-DC converter 3 (the negative side of the capacitor C1). A control terminal of the switching device Q2 (a gate terminal in the example) is connected to the second control circuit 6.

A first end of the inductor L4 in the transformer T1 is connected to an anode side of the diode D3. A cathode of the diode D3 is connected to a positive side of the capacitor C3. A negative side of the capacitor C3 is connected to a second end of the inductor L4. Both ends of the capacitor C3 constitute output ends of the DC-DC converter 4.

A side of the positive output end of the DC-DC converter 4 (the positive side of the capacitor C3) is connected to a first end (an anode) of the light source 20 through the first power output terminal 16*a*. A side of the negative output end of the DC-DC converter 4 (the negative side of the capacitor C3) is connected to a second end (a cathode) of the light source 20 through the second power output terminal 16*b*.

In the electronic ballast 10 of the embodiment, a voltage across the capacitor C3 as the second DC voltage V2 (an output voltage of the DC-DC converter 4) is to be applied across the light source 20 through the first and second power output terminals 16*a* and 16*b*. Thus, the light source 20 can operate by the output voltage of the DC-DC converter 4.

In the embodiment, the DC-DC conversion circuit 41 of the DC-DC converter 4 is formed of the flyback converter, but not limited to this. Examples of the DC-DC conversion circuit 41 include a forward converter as shown in FIG. 2A, a boost chopper circuit (a boost converter) as shown in FIG. 2B, a boost/buck chopper circuit (a boost/buck converter) as shown in FIG. 2C, and a buck chopper circuit (a buck converter) as shown in FIG. 2D.

Figure 2A:
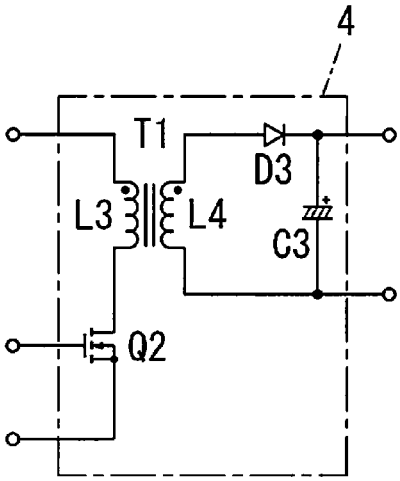
FIGS. 2A to 2D exemplify other configurations of a DC-DC converter in the electronic ballast.

In the forward converter of FIG. 2A, a first end of an inductor L3 is connected to the positive side of the capacitor C1 in the AC-DC converter 3. A second end of the inductor L3 is connected to a drain terminal of a switching device Q2. A source terminal of the switching device Q2 is connected to the negative side of the capacitor C1. A gate terminal of the switching device Q2 is connected to the second control circuit 6. A first end of an inductor L4 is connected to an anode side of a diode D3. A cathode of the diode D3 is connected to a positive side of a capacitor C3. A negative side of the capacitor C3 is connected to a second end of the inductor L4. The positive and negative sides of the capacitor C3 are connected to the first and second power output terminals 16*a* and 16*b*, respectively.

Figure 2B:
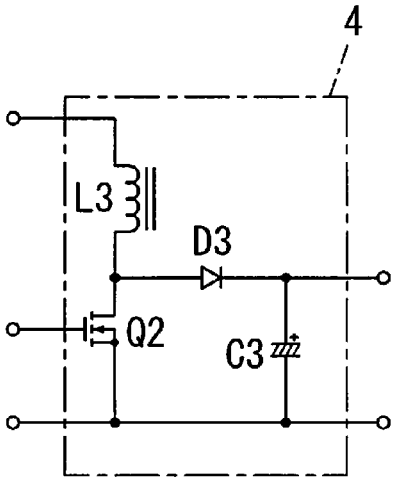

In the boost chopper circuit of FIG. 2B, a first end of an inductor L3 is connected to the positive side of the capacitor C1 in the AC-DC converter 3. A second end of the inductor L3 is connected to a drain terminal of a switching device Q2. The drain terminal of the switching device Q2 is connected to an anode side of a diode D3. A cathode of the diode D3 is connected to a positive side of a capacitor C3. A negative side of the capacitor C3 is connected to a source terminal of the switching device Q2. A source terminal of the switching device Q2 is connected to the negative side of the capacitor C1. A gate terminal of the switching device Q2 is connected to the second control circuit 6. The positive and negative sides of the capacitor C3 are connected to the first and second power output terminals 16*a* and 16*b*, respectively.

Figure 2C:
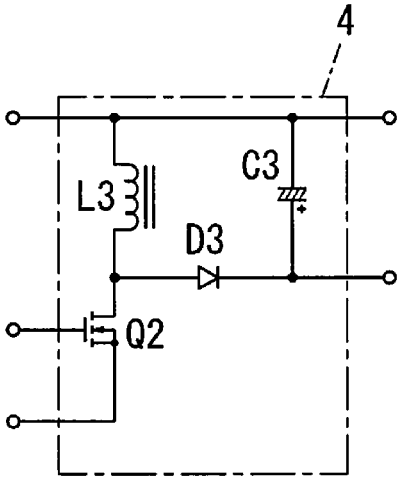
Figure 2D:
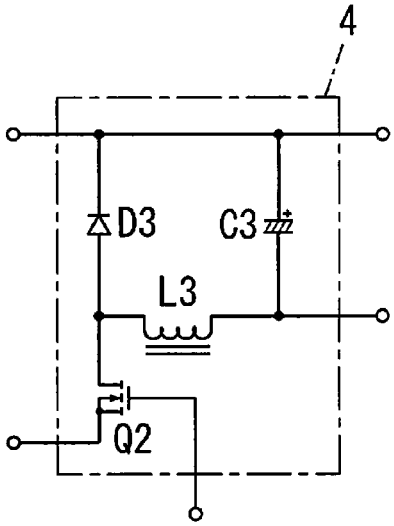

In the boost/buck chopper circuit of FIG. 2C, a first end of an inductor L3 is connected to the positive side in the AC-DC converter 3. A second end of the inductor L3 is connected to a drain terminal of a switching device Q2. A source terminal of the switching device Q2 is connected to the negative side of the capacitor C1. A gate terminal of the switching device Q2 is connected to the second control circuit 6. A first end of the inductor L3 is connected to a negative side of a capacitor C3. A positive side of the capacitor C3 is connected to a cathode of a diode D3. An anode side of the diode D3 is connected to a second end of the inductor L3. The positive and negative sides of the capacitor C3 are connected to the first and second power output terminals 16*a* and 16*b*, respectively.

In the buck chopper circuit of FIG. 2D, a cathode of a diode D3 is connected to the positive side of the capacitor C1 in the AC-DC converter 3. An anode side of a diode D3 is connected to a drain terminal of a switching device Q2. A source terminal of the switching device Q2 is connected to the negative side of the capacitor C1. A gate terminal of the switching device Q2 is connected to the second control circuit 6. The cathode of the diode D3 is connected to a positive side of a capacitor C3. A negative side of the capacitor C3 is connected to a first end of an inductor L3. A second end of the inductor L3 is connected to an anode side of the diode D3. The positive and negative sides of the capacitor C3 are connected to the first and second power output terminals 16*a* and 16*b*, respectively.

The first control circuit 5 may be formed of, for example, a control IC (integrated circuit). As a concrete example, the control IC of the first control circuit 5 may be, but not limited to, a control IC such as FA5501A control IC for power factor correction, manufactured by Fuji Electric.

The first control circuit 5 is configured to control ON and OFF (switching) of the switching device Q1 in the chopper circuit 28 of the AC-DC converter 3.

The second control circuit 6 may be formed of, for example, a control IC. As a concrete example, the control IC of the second control circuit 6 may be, but not limited to, a control IC such as FA5546 control IC for PWM (pulse width modulation) control, manufactured by Fuji Electric.

The second control circuit 6 is configured to control ON and OFF (switching) of the switching device Q2 in the DC-DC conversion circuit 41 of the DC-DC converter 4.

The first power supply 7 may be formed of, for example, a power supply IC. As a concrete example, the power supply IC of the first power supply 7 may be, but not limited to, MIP3530MS Intelligent Power Device (hereinafter referred to as "IPD"), manufactured by Panasonic.

Figure 3:
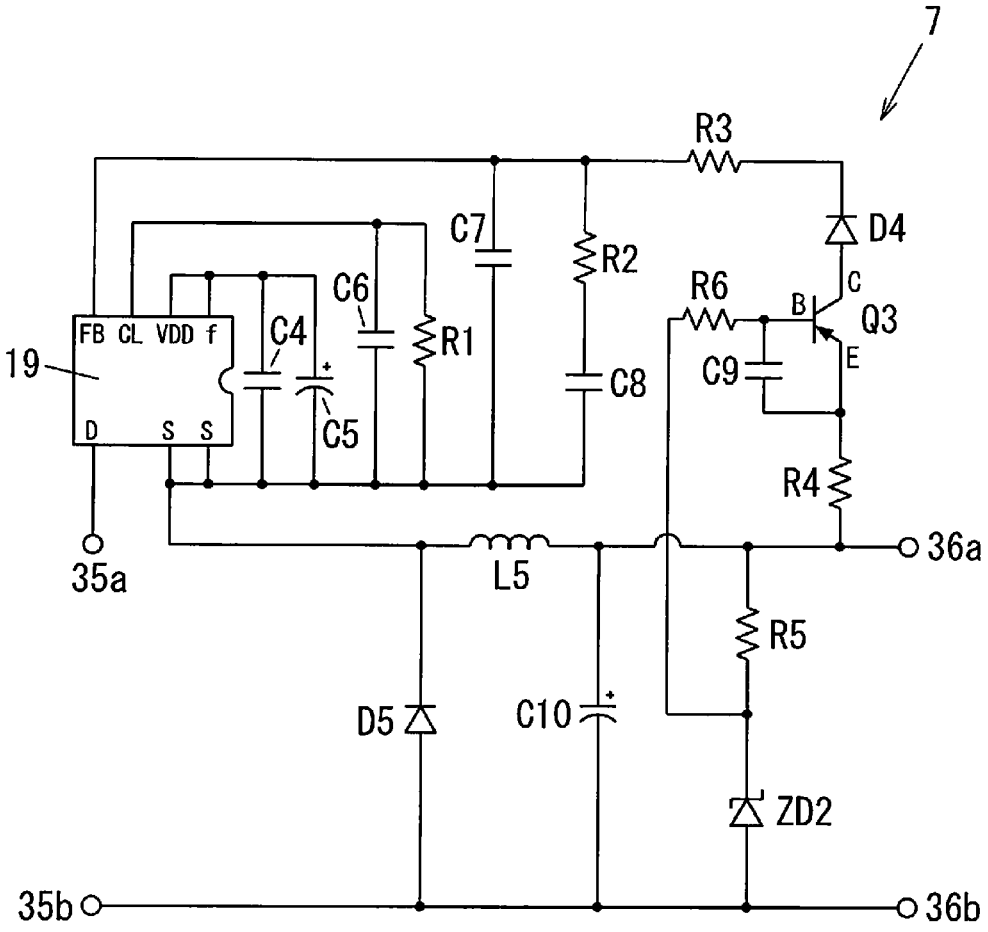
FIG. 3 exemplifies a circuit diagram of a first power supply in the electronic ballast.

As shown in FIG. 3, the first power supply 7 includes an IPD 19, six resistors R1 to R6, seven capacitors C4 to C10, an inductor L5, two diodes D4 and D5, a switching device Q3 and a Zener diode ZD2. In addition, the first power supply 7 includes first and second input terminals 35*a* and 35*b*, and first and second output terminals 36*a* and 36*b*. In an example of FIG. 3, a PNP bipolar transistor is employed as the switching device Q3.

As shown in FIG. 3, pin #1 of the IPD 19, depicted by "f" is connected to pin #2 of the IPD 19, depicted by "VDD". Pin #1 and pin #2 of the IPD 19 are connected to pin #7 and pin #8 of the IPD 19, depicted by two "S" through a parallel circuit of the capacitors C4 and C5. Pin #3 of the IPD 19, depicted by "CL" is connected to pin #7 and #8 of the IPD 19 through a parallel circuit of the capacitor C6 and the resistor R1. Pin #4 of the IPD 19, depicted by "FB" is connected to pin #7 and #8 of the IPD 19 through a parallel circuit of the capacitor C7 and a series circuit of the resistor R2 and the capacitor C8. The resistor R2 is connected to pin #4 of the IPD 19, and the capacitor C8 is connected to pin #7 and pin #8 of the IPD 19.

An end of the resistor R2 connected to pin #4 of the IPD 19 is connected to a cathode side of the diode D4 through the resistor R3. An anode side of the diode D4 is connected to a first end (a collector terminal in the example of FIG. 3) of the switching device Q3. A second terminal (an emitter terminal in the example) of the switching device Q3 is connected to the first output terminal 36*a* through the resistor R4. A control terminal (a base terminal in the example) of the switching device Q3 is connected to the emitter terminal of the switching device Q3 through the capacitor C9. A series circuit of the resistor R5 and the Zener diode ZD2 is connected between the first and second output terminals 36*a* and 36*b*. An anode side of the Zener diode ZD2 is connected to the second output terminal 36*b*. A cathode side of the Zener diode ZD2 is connected to the resistor R5. The base terminal of the switching device Q3 is connected to a junction of the resistor R5 and the Zener diode ZD2 through the resistor R6.

The series circuit of the resistor R5 and the Zener diode ZD2 is connected in parallel with the capacitor C10. A positive side of the capacitor C10 is connected to one end of the resistor R5 connected to the first output terminal 36*a*. A negative side of the capacitor C10 is connected to the anode of the Zener diode ZD2 connected to the second output terminal 36*b*. The positive side of the capacitor C10 is connected to a cathode of the diode D5 through the inductor L5. The negative side of the capacitor C10 is connected to an anode of the diode D5. The cathode side of the diode D5 is connected to pin #7 and pin #8 of the IPD 19. The anode side of the diode D5 is connected to the second input terminal 35*b*. The first input terminal 35*a* is connected to pin #5 of the IPD 19, depicted by "D".

In the embodiment, the first input terminal 35*a* is connected to the positive side of the capacitor C1 in the AC-DC converter 3, and the second input terminal 35*b* is connected to the negative side of the capacitor C1. In the example of FIG. 1, the first output end 36*a* is connected to the first control circuit 5, the second control circuit 6 and the third power supply 9, and the second output terminal 36*b* is connected to a common ground (not shown) of the first control circuit 5 and the second control circuit 6.

The first power supply 7 is configured to generate the first operating voltage V11 from a voltage across the capacitor C1 (an output voltage of the AC-DC converter 3) as the first DC voltage V1, and to supply the first operating voltage V11 to the first control circuit 5, the second control circuit 6 and the third power supply 9.

The cooling device 12 may be formed of an air cooling device (e.g., an axial flow fan). In the example of FIG. 1, the cooling device 12 includes the rotor (the impeller) 13 and the driver 14. The rotor (the impeller) 13 includes vanes 13*a*, and a rotation axis 13*b* to which the vanes 13*a* are attached, and is configured so that the vanes 13*a* are free to rotate clockwise or counterclockwise around the rotation axis 13*b*. The driver 14 is configured to drive the rotor 13. For example, the driver 14 is formed of a DC motor, and connected to the positive side of the capacitor C2 in the second power supply 8. In the embodiment, the driver 14 is formed of the DC motor, but the invention is not limited to this. As an embodiment of the invention, the driver 14 may be formed of a pulse motor or the like. In this case, it is possible to suitably set a rotation speed of the rotor 13 and to adjust cooling capability of the cooling device 12. In the example of FIG. 1, the cooling device 12 is formed of the air cooling device, but is not limited to this. Examples of the cooling device 12 include a water cooling device configured to circulate water with a pump, a Peltier cooling device with Peltier element, and the like.

The cooling device 12 is configured to operate by receiving electric power from the inductor L2 as the secondary winding magnetically coupled to the inductor L1 as the primary winding in the chopper circuit 28. That is, in the electronic ballast 10, a first voltage (an induced voltage) induced across the inductor L2 is to be applied across the capacitor C2 through the diode D2. A voltage across the capacitor C2 is to be then supplied as the second operating voltage V12 to the driver 14. In the example of FIG. 1, the diode D2 and the capacitor C2 constitute a rectifier smoothing circuit configured to rectify the first voltage induced across the inductor L2 and also to remove the ripples therefrom. In the embodiment, the first voltage induced across the inductor L2 is set to, for example, a voltage in a range of 5 to 12V.

It is therefore possible to supply the driver 14 with the second operating voltage V12 obtained from the first voltage induced across the inductor L2 to operate the cooling device 12. As a result, the electronic ballast 10 can effectively dissipate heat generated in the light source 20. In the embodiment, the second operating voltage V12 is set to, for example, a voltage in a range of 5 to 12V.

Since the Zener diode ZD1 is connected in parallel with the capacitor C2, the electronic ballast 10 can prevent the second operating voltage V12 from exceeding a Zener voltage of the Zener diode ZD1. As a result, the electronic ballast 10 prevent malfunction of the cooling device 12. In the embodiment, the Zener voltage of the Zener diode ZD1 is set to, for example, 12V.

In the embodiment, the second power supply 8 configured to generate the second operating voltage V12 for activating only the cooling device 12 is physically separated from the first power supply 7, and accordingly the electronic ballast 10 can supply a stable voltage to the cooling device 12. In addition, since the second operating voltage V12 is supplied from the second power supply 8 to the cooling device 12, the electronic ballast 10 can further increase the second operating voltage V12 in comparison with the LED lighting device of Document 1. It is accordingly possible to employ the cooling device 12 having higher cooling capability. As a result, the electronic ballast 10 can further prevent light source's (20) temperature from rising in comparison with the LED lighting device of Document 1.

The main controller 11 is formed of, for example, a microcomputer and a suitable program installed in the main controller 11. The program is stored in a memory unit (not shown) provided in the microcomputer.

The main controller 11 is connected to each of the first control circuit 5 and the second control circuit 6. That is, the main controller 11 is configured to control ON and OFF of the switching device Q1 in the chopper circuit 28 through the first control circuit 5 and also to control ON and OFF of the switching device Q2 in the DC-DC conversion circuit 41 through the second control circuit 6.

The main controller 11 is also connected with the temperature sensor 15 that is configured to detect (measure) the light source' (20) temperature. The temperature sensor 15 may be formed of, for example, a thermistor or the like. For example, the main controller 11 may be configured to activate the cooling device 12 by controlling ON and OFF of the switching device Q1 in the chopper circuit 28 through the first control circuit 5 if the temperature sensor 15 detects that the light source' (20) temperature is a predetermined temperature or more. In this example, heat generated in the light source 20 can be dissipated effectively.

The main controller 11 is further connected to the signal input terminal 17. In the embodiment, the main controller 11 is configured to receive a dimming signal from the signal input terminal 17. Examples of the dimming signal include a DALI (Digital Addressable Lighting Interface) signal, a DMX (Digital Multiplex) signal, a PWM (Pulse Width Modulation) signal, a DC (Direct Current) signal, and the like.

The main controller 11 is configured to control the switching device Q2 in the DC-DC conversion circuit 41 through the second control circuit 6 in accordance with a dimming signal if receiving the dimming signal. Specifically, the main controller 11 is configured to control ON duty ratio of the switching device Q2 in the DC-DC conversion circuit 41 through the second control circuit 6 in accordance with a dimming signal if receiving the dimming signal. As a result, the electronic ballast 10 can control light output of the light source 20.

In the embodiment, the main controller 11 is configured, if receiving a dimming signal, to control ON duty ratio of the switching device Q2 in accordance with the dimming signal, but the invention is not limited to this. As an embodiment of the invention, the main controller 11 may be configured to control OFF duty ratio of the switching device Q2.

In the embodiment, the main controller 11 is configured, if receiving a dimming signal, to control the switching device Q2 through the second control circuit 6 in accordance with the dimming signal, but the invention is not limited to this. As an embodiment of the invention, the main controller 11 may be configured to control the switching device Q1 through the first control circuit 5 in accordance with a dimming signal. For example, the main controller 11 may be configured, if receiving a dimming signal, to control ON duty ratio or OFF duty ratio of the switching device Q1 in the chopper circuit 28 through the first control circuit 5 in accordance with the dimming signal. As another example, the main controller 11 may be configured, if receiving a dimming signal, to control the switching devices Q1 and Q2 through the first and second control circuits 5 and 6 in accordance with the dimming signal.

The third power supply 9 may be formed of, for example, a three-terminal regulator. For example, the third power supply 9 may be formed of, but not limited to, a device such as S-812C series voltage regulator manufactured by Seiko Instruments.

In the example of FIG. 1, an input terminal and an output terminal of the third power supply 9 are connected to the first power supply 7 and the main controller 11, respectively. A ground terminal (not shown) of the third power supply 9 is connected to a ground (not shown) of the electronic ballast 10.

The third power supply 9 is configured to generate the third operating voltage V13 from the first operating voltage V11 of the first power supply 7 to supply the third operating voltage V13 to the main controller 11.

In the embodiment, each of the first control circuit 5 and the second control circuit 6 includes a control IC, but the invention is not limited to this. As an embodiment of the invention, each of the first control circuit 5 and the second control circuit 6 may include a microcomputer and a suitable program installed in the microcomputer. As another embodiment, both of the first control circuit 5 and the second control circuit 6 may be formed of one microcomputer.

In the embodiment, the light source 20 includes at least a light-emitting diode as at least a solid-state light-emitting device 21, but the invention is not limited to this. As an embodiment of the invention, the light source 20 may include an organic electroluminescence element(s), a semiconductor laser element(s) or the like.

As described above, the electronic ballast 10 in the embodiment includes the AC-DC converter 3, the DC-DC converter 4, the cooling device 12 and the power supply 1A. The AC-DC converter 3 includes the chopper circuit 28 and the first control circuit 5. The chopper circuit 28 is configured to convert an AC voltage $V_{AC}$ from the commercial power supply 1 into a first DC voltage V1. The DC-DC converter 4 includes the DC-DC conversion circuit 41 and the second control circuit 6. The DC-DC conversion circuit 41 is configured to convert the first DC voltage V1 into a second DC voltage V2 to supply the second DC voltage V2 to the light source 20. The cooling device 12 is configured to cool the light source 20. The first control circuit 5 is configured to control the chopper circuit 28. The second control circuit 6 is configured to control the DC-DC conversion circuit 41. The power supply 1A includes the first power supply 7 and the second power supply 8. The first power supply 7 is configured to generate a first operating voltage V11 from a first voltage obtained from the chopper circuit 28 to supply the first operating voltage V11 to the first control circuit 5 and the second control circuit 6. The first voltage is the first DC voltage V1. The second power supply 8 is configured to generate a second operating voltage V12 from a second voltage obtained from the chopper circuit 28 to supply the second operating voltage V12 to the cooling device 12. The second power supply 8 includes the inductor L2 magnetically coupled to the inductor L1 of the chopper circuit 28, and the second voltage is obtained from the inductor L2. As a result, the electronic ballast 10 in the embodiment can supply a stable voltage (the second operating voltage V12) to the cooling device 12, and further prevent light source's (20) temperature from rising.

An example of a luminaire with the electronic ballast 10 in the embodiment is now explained with reference to FIG. 4.

The luminaire of the embodiment includes the light source 20 and the electronic ballast 10 configured to operate the light source 20. The light source 20 and the electronic ballast 10 are to be arranged individually, and the luminaire includes a pair of connecting wires 39 and 39 for connecting the light source 20 and a part of the electronic ballast 10. In FIG. 4, one of the connecting wires 39 and 39 is seen. It is accordingly possible to downsize the light source 20.

The light source 20 includes a light emitting module 30 with a mounting substrate 29 on which the solid-state light-emitting devices 21 are mounted, and a case 31 to which the light emitting module 30 is detachably attached. In FIG. 4, only five solid-state light-emitting devices 21 of the light emitting module 30 are seen.

The mounting substrate 29 may be formed of, for example, a metal-based printed circuit board or the like. Preferably, a planar shape of the mounting substrate 29 is a circular shape, but may be a polygonal shape or the like. In the embodiment, the mounting substrate 29 is formed of the metal-based printed circuit board, but not limited to this. Examples of the mounting substrate 29 include a ceramic substrate, a glass epoxy substrate, a paper phenol substrate and the like.

The light emitting module 30 is attached to the case 31 through an insulation sheet 22 that has electric insulation and thermal conductivity.

For example, the case 31 is shaped like a tube with a top base (e.g., a cylinder with a top base). For example, metal such as aluminum, stainless steel, iron, or the like may be employed as material of the case 31.

The light emitting module 30 is disposed on an inner surface of the top base of the case 31 through the insulation sheet 22. As a result, the luminaire of the embodiment can effectively transmit heat generated in the light emitting module 30 to the case 31.

Figure 4:
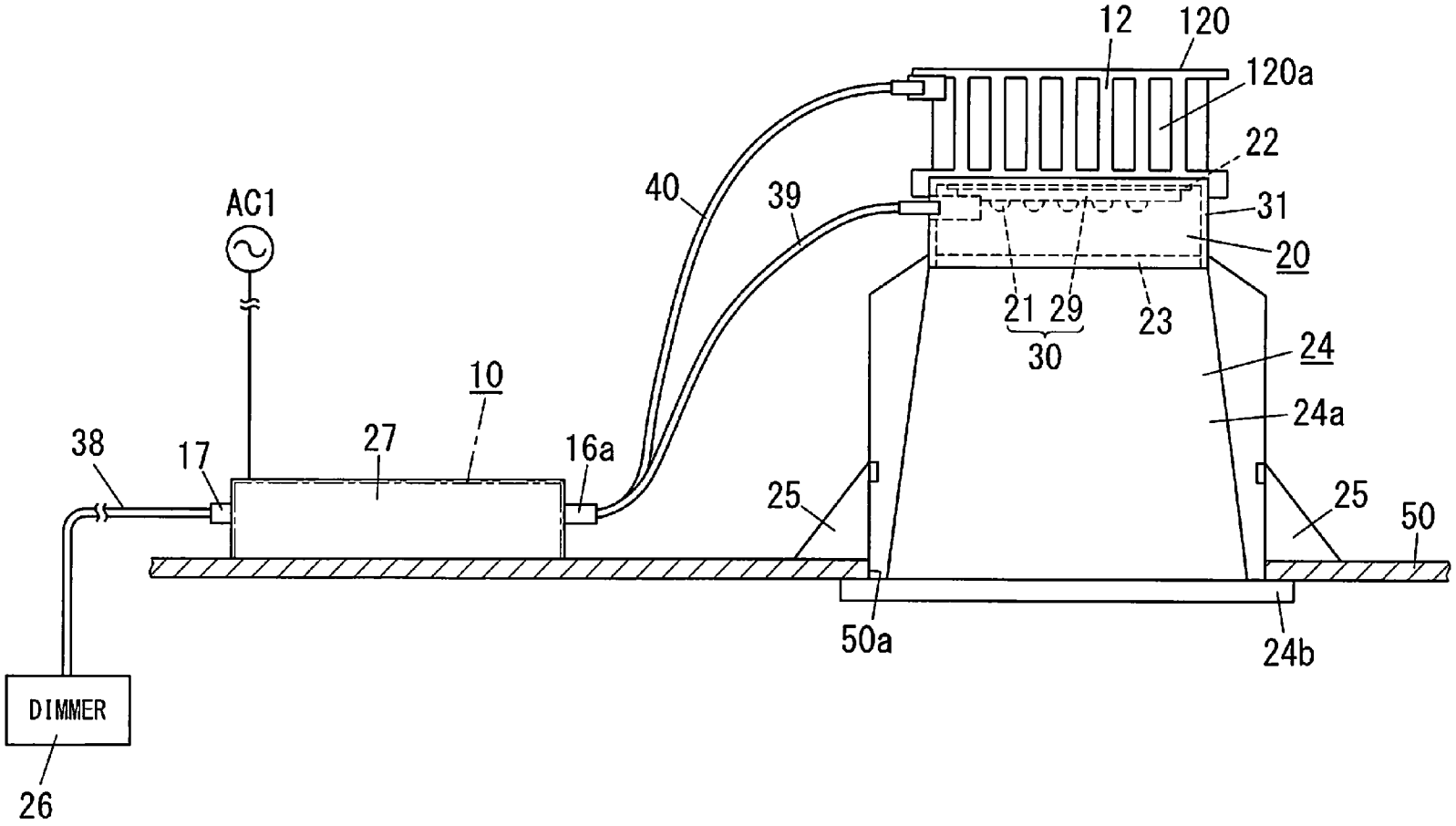
FIG. 4 exemplifies a schematic diagram of luminaire with the electronic ballast.

A diffuser panel 23 configured to diffuse light emitted from the solid-state light-emitting devices 21 is disposed at an opening side of the case 31 (at a lower side in FIG. 4). For example, the diffuser panel 23 is shaped like a board (e.g., a disc). For example, optically-transparent material such as acrylic resin, glass, or the like may be employed as material of the diffuser panel 23.

The luminaire of the embodiment includes a fixture body 24 configured to retain the light source 20.

The fixture body 24 is formed of a tubular side wall 24*a* and a flange 24*b* protruded laterally from a lower edge of the side wall 24*a*. For example, metal such as aluminum, stainless steel, iron, or the like may be employed as material of the fixture body 24.

An inside of the side wall 24*a* is shaped like a reversed tapered tube such that an aperture area (an inside diameter) of the side wall 24*a* becomes gradually wider (larger) from a top end to a bottom end in the side wall 24*a*. The light source 20 (the case 31) is disposed at the top end of the side wall 24*a*. In the luminaire of the embodiment, the diffuser panel 23 is disposed at the opening side of the case 31 in the light source 20, but the invention is not limited to this. As an embodiment of the invention, the diffuser panel 23 may be disposed at a side of the bottom end of the side wall 24*a* in the fixture body 24.

A pair of mounting brackets 25 and 25 is disposed outside the side wall 24*a* of the fixture body 24, and configured to hold part of a ceiling panel 50, around a hole 50*a* cut in the ceiling panel 50, between the flange 24*b* and the pair of mounting brackets 25 and 25. With the side wall 24*a* inserted into the hole 50*a* of the ceiling panel 50 such that the flange 24*b* is in contact with a lower surface of the ceiling panel 50 around the hole 50*a*, the part of the ceiling panel 50 is held between the flange 24*b* and the pair of mounting brackets 25 and 25. As a result, the fixture body 24 is recessed in the ceiling panel 50.

The luminaire of the embodiment further includes a case 27 that houses components other than the cooling device 12 in the electronic ballast 10, namely the filter 2, the AC-DC converter 3, the DC-DC converter 4, the power supply 1A, the main controller 11, the pair of power input terminal 1*a* and 1*b*, the first and second power output terminals 16*a* and 16*b* and the signal input terminal 17.

The case 27 is shaped like a box (e.g., a rectangular box). Examples of material of the case 27 include metal, resin and the like. In the example of FIG. 4, the case 27 is disposed on an upper surface of the ceiling panel 50.

The signal input terminal 17 is exposed at a first side wall (a left side wall in the example of FIG. 4) of the case 27. In the luminaire of the embodiment, the signal input terminal 17 is connected to a dimmer 26 through a connecting cable 38. The dimmer 26 is configured to output a dimming signal. In the embodiment, a connection means for connecting the electronic ballast 10 and the dimmer 26 is formed of the connecting cable 38, but may be formed of a communication device using communication media such as infrared or radio wave.

The first and second power output terminals 16*a* and 16*b* are exposed at a second side wall (a right side wall in the example of FIG. 4) of the case 27. In the luminaire of the embodiment, the first and second power output terminals 16*a* and 16*b* are connected to the light source 20 through a pair of connecting wires 39 and 39. In the example of FIG. 4, one of the first and second power output terminals 16*a* and 16*b*, namely the first power output terminal 16*a* is seen.

The second side wall of the case 27 is also formed with a through hole (not shown) into which a connecting cable 40 electrically connected to the cooling device 12 is inserted.

In the luminaire of the embodiment, the cooling device 12 of the electronic ballast 10 is fixed to an opposite side of the top base of the case 31 from the opening of the case 31. In short, the cooling device 12 is fixed to the light source 20. The cooling device 12 shown in the example of FIG. 4 includes a case 120 housing the rotor (the impeller) 13 and the driver 14 (see FIG. 1), and slits 120*a* are formed in a peripheral wall of the case 120.

Therefore, the luminaire of the embodiment can cool the light source 20 through the cooling device 12 and effectively dissipate heat transmitted from the solid-state light-emitting devices 21 to the case 31.

In the luminaire of the embodiment, the light source 20 and the electronic ballast 10 are arranged individually (lighting system with separate ballast), but the invention is not limited to this. As an embodiment of the invention, the light source 20 and the electronic ballast 10 may be housed in the fixture body 24 so as to constitute a single luminaire (luminaire with built-in ballast).

As described above, the luminaire of the embodiment includes the light source 20 and the electronic ballast 10 configured to operate the light source 20. Therefore, the luminaire of the embodiment can supply a stable voltage (the second operating voltage V12) to the cooling device 12, and further prevent light source's (20) temperature from rising.

An electronic ballast 10 in accordance with an embodiment of the present invention is explained with reference to FIG. 5. The electronic ballast 10 of the embodiment differs from the embodiment as shown in FIGS. 1 to 3 in that a first power supply 7 is configured to supply a first operating voltage V11 to one of a first control circuit 5 and a second control circuit 6, while a second power supply 8 is configured to supply a second operating voltage V12 to a cooling device 12 and an other of the first control circuit 5 and the second control circuit 6. In an example of FIG. 5, the first power supply 7 is configured to supply the first operating voltage V11 to the second control circuit 6, while the second power supply 8 is configured to supply the second operating voltage V12 to the cooling device 12 and the first control circuit 5. Like kind elements are assigned the same reference numerals as depicted in the embodiment as shown in FIGS. 1 to 3 and not described in detail herein.

Figure 5:
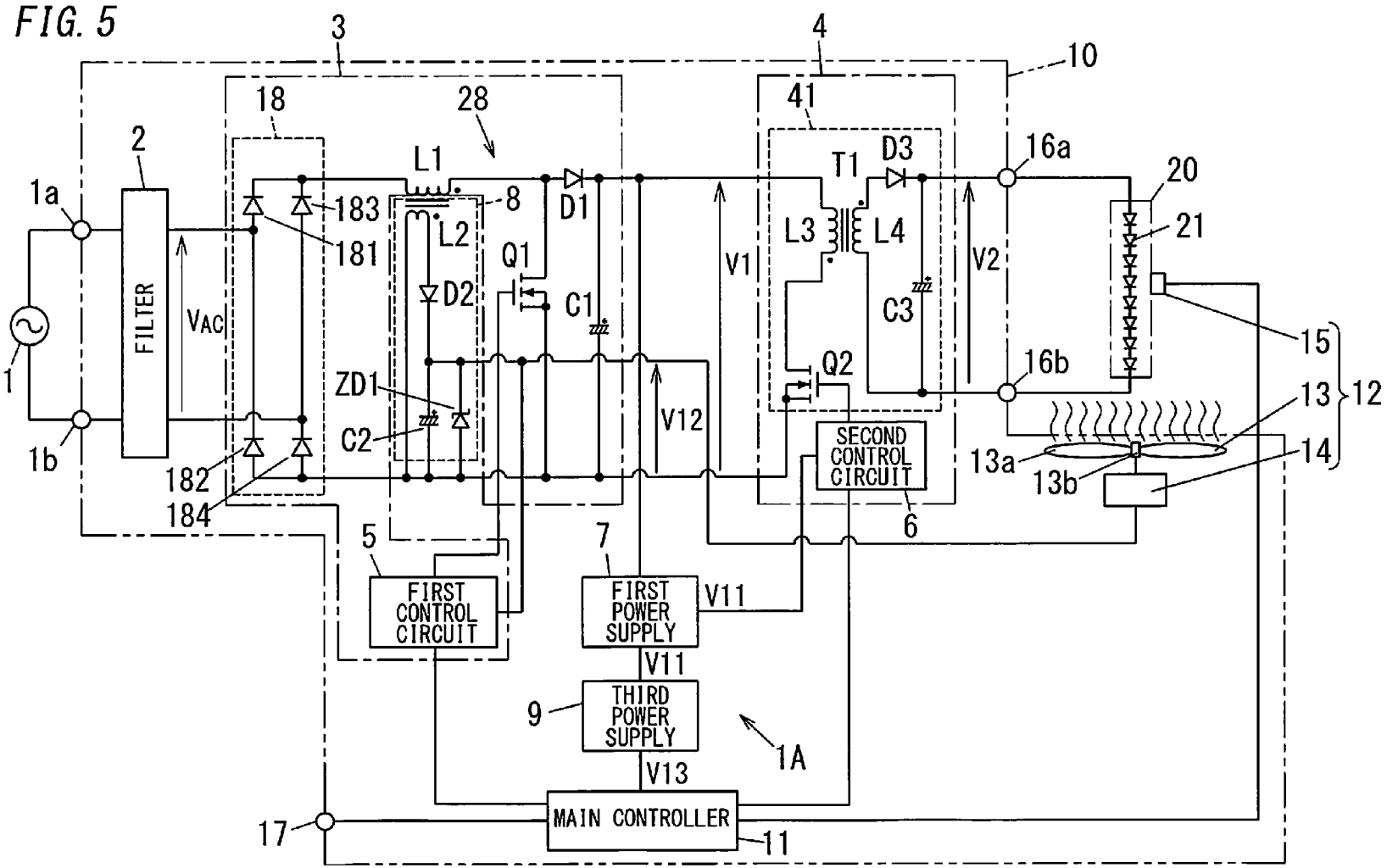
FIG. 5 exemplifies a schematic circuit diagram of an electronic ballast in accordance with an embodiment of the present invention.

In the example of FIG. 5, the first control circuit 5 is electrically connected to a positive side of a capacitor C2 in the second power supply 8.

In the electronic ballast 10 of the embodiment, a voltage across the capacitor C2 is supplied as the second operating voltage V12 to the first control circuit 5. In this embodiment, it is unnecessary that the first power supply 7 supply the first operating voltage V11 to the first control circuit 5, and the first power supply 7 can be accordingly simplified in comparison with the first power supply 7 shown in FIGS. 1 to 3.

In the example of FIG. 5, a voltage across the capacitor C2 in the second power supply 8 is supplied to the first control circuit 5, but may be supplied to the second control circuit 6. That is, as an alternative example, the second power supply 8 (an inductor L2) is configured to supply the second operating voltage V12 to the second control circuit 6 in place of the first power supply 7, while the first power supply 7 is configured to supply the first operating voltage V11 to the first control circuit 5.

As described above, in the electronic ballast 10 shown in FIG. 5, the first power supply 7 is configured to supply the first operating voltage V11 to the second control circuit 6, while the second power supply 8 is configured to supply the second operating voltage V12 to the cooling device 12 and the first control circuit 5. As a result, in the electronic ballast 10, the first power supply 7 can be simplified in comparison with the first power supply 7 in the embodiment as shown in FIGS. 1 to 3.

The electronic ballast 10 of the embodiment may be applied to the luminaire shown in FIG. 4.

An electronic ballast 10 in accordance with an embodiment of the present invention is explained with reference to FIG. 6. The electronic ballast 10 of the embodiment differs from the embodiment as shown in FIGS. 1 to 3 in that a first power supply 7 is configured to generate a first operating voltage V11 from a first DC voltage V1 to supply the first operating voltage V11 to a first control circuit 5 and a second control circuit 6, while a second power supply 8 is configured to generate a second operating voltage V12 from the first DC voltage V1 to supply the second operating voltage V12 to a cooling device 12. Like kind elements are assigned the same reference numerals as depicted in the embodiment as shown in FIGS. 1 to 3 and not described in detail herein.

Figure 6:
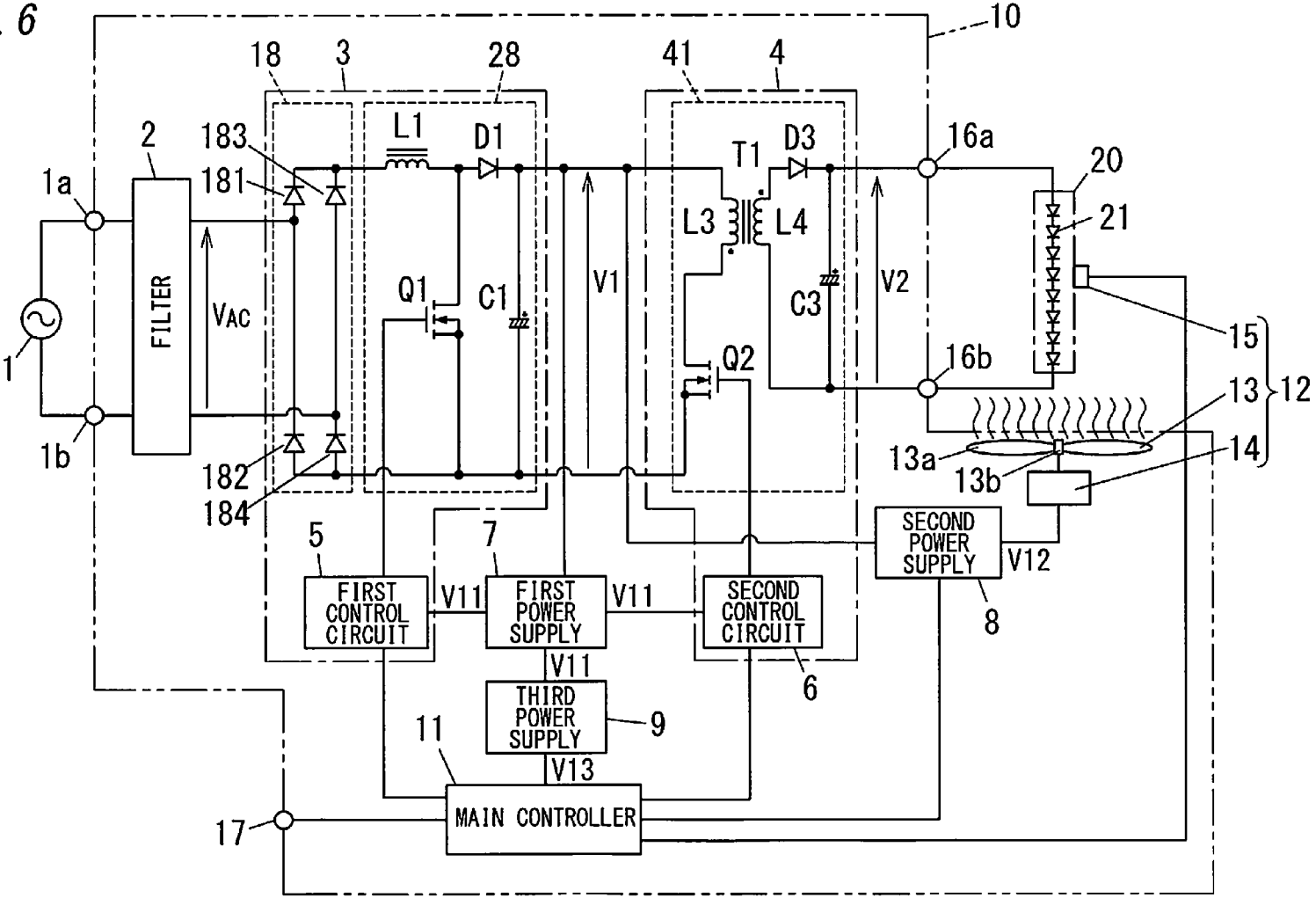
FIG. 6 exemplifies a schematic circuit diagram of an electronic ballast in accordance with an embodiment of the present invention.

In an example of FIG. 6, the second power supply 8 is configured to generate the second operating voltage V12 for the cooling device 12. In the embodiment, the first operating voltage V11 is set to, for example, 12V and the second operating voltage V12 is set to, for example, a voltage in a range of 5 to 12V.

In the example of FIG. 6, the electronic ballast 10 includes a main controller 11 configured to individually control the first control circuit 5, the second control circuit 6 and the second power supply 8.

The second power supply 8 may be formed of, for example, a control IC or the like. In the embodiment, the second power supply 8 is formed of, but not limited to, MIP3530MS IPD for switching power supply, manufactured by Panasonic, like the first power supply 7 shown in FIG. 3. In the example of FIG. 6, a first output terminal 35*a* (see FIG. 3) of the second power supply 8 is connected to a positive side of a capacitor C1 in an AC-DC converter 3, and a second input terminal 35*b* (see FIG. 3) of the second power supply 8 is connected to a negative side of the capacitor C1. In addition, a first output terminal 36*a* (see FIG. 3) of the second power supply 8 is connected to a driver 14, and a second output terminal 36*b* (see FIG. 3) of the second power supply 8 is connected to ground (not shown) of the electronic ballast 10.

That is, the second power supply 8 is configured to generate the second operating voltage V12 from a voltage across the capacitor C1 in the AC-DC converter 3 (an output voltage of the AC-DC converter 3) to supply the second operating voltage V12 to the driver 14.

Thus, in the electronic ballast 10 of the embodiment, the second power supply 8 configured to generate the second operating voltage V12 for driving only the cooling device 12 is provided separately from the first power supply 7, and it is accordingly possible to supply a stable voltage to the cooling device 12. The second operating voltage V12 is supplied from the second power supply 8 to the cooling device 12, and therefore the electronic ballast 10 can further increase the second operating voltage V12 for driving the cooling device 12 in comparison with the LED lighting device of Document 1 and employ the cooling device 12 having higher cooling capability. As a result, the electronic ballast 10 can further prevent light source's (20) temperature from rising in comparison with the LED lighting device of Document 1.

In the example of FIG. 6, the main controller 11 is connected to the second power supply 8. Accordingly, the main controller 11 can supply the second operating voltage V12 to the driver 14 through the second power supply 8, and activate the cooling device 12.

As described above, the electronic ballast 10 of the embodiment includes the first power supply 7 configured to generate the first operating voltage V11 for activating the first and second control circuits 5 and 6, and the second power supply 8 configured to generate the second operating voltage V12 for activating the cooling device 12. In this electronic ballast 10, the first power supply 7 is to generate the first operating voltage V11 from the first DC voltage V1 as the output voltage of the AC-DC converter 3, and the second power supply 8 is to generate the second operating voltage V12 from the first DC voltage V1. As a result, the electronic ballast 10 of the embodiment can supply a stable voltage (the second operating voltage V12) to the cooling device 12 and further prevent light source's (20) temperature from rising.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. An electronic ballast, comprising:

an AC-DC converter comprising a chopper circuit configured to convert an AC voltage from a commercial power supply into a first DC voltage;

a DC-DC converter comprising a DC-DC conversion circuit configured to convert the first DC voltage into a second DC voltage to supply the second DC voltage to a light source including at least a solid-state light-emitting device;

a cooling device configured to cool the light source; and a power supply comprising a first power supply configured to generate a first operating voltage from a first voltage obtained from the chopper circuit to supply the first operating voltage to at least one of the AC-DC converter and the DC-DC converter, and a second power supply configured to generate a second operating voltage from a second voltage obtained from the chopper circuit to supply the second operating voltage to at least the cooling device of the AC-DC converter, the DC-DC converter and the cooling device, wherein:

the chopper circuit comprises an inductor;

the AC-DC converter further comprises a first control circuit configured to control the chopper circuit;

the DC-DC converter further comprises a second control circuit configured to control the DC-DC conversion circuit;

the first power supply is configured to supply the first operating voltage to the first control circuit and the second control circuit, and the first voltage is the first DC voltage; and the second power supply comprises an inductor magnetically coupled to the inductor of the chopper circuit and is configured to supply the second operating voltage to the cooling device, and the second voltage is obtained from the inductor of the second power supply.

2. An electronic ballast, comprising:

an AC-DC converter comprising a chopper circuit configured to convert an AC voltage from a commercial power supply into a first DC voltage;

a DC-DC converter comprising a DC-DC conversion circuit configured to convert the first DC voltage into a second DC voltage to supply the second DC voltage to a light source including at least a solid-state light-emitting device;

a cooling device configured to cool the light source; and a power supply comprising a first power supply configured to generate a first operating voltage from a first voltage obtained from the chopper circuit to supply the first operating voltage to at least one of the AC-DC converter and the DC-DC converter, and a second power supply configured to generate a second operating voltage from a second voltage obtained from the chopper circuit to supply the second operating voltage to at least the cooling device of the AC-DC converter, the DC-DC converter and the cooling device, wherein:

the chopper circuit comprises an inductor;

the AC-DC converter further comprises a first control circuit configured to control the chopper circuit;

the DC-DC converter further comprises a second control circuit configured to control the DC-DC conversion circuit;

the first power supply is configured to supply the first operating voltage to one of the first control circuit and the second control circuit, while the second power supply is configured to supply the second operating voltage to the cooling device and an other of the first control circuit and the second control circuit; and the second power supply comprises an inductor magnetically coupled to the inductor of the chopper circuit, and the second voltage is obtained from the inductor of the second power supply.

3. An electronic ballast, comprising:

an AC-DC converter comprising a chopper circuit configured to convert an AC voltage from a commercial power supply into a first DC voltage;

a DC-DC converter comprising a DC-DC conversion circuit configured to convert the first DC voltage into a second DC voltage to supply the second DC voltage to a light source including at least a solid-state light-emitting device;

a cooling device configured to cool the light source; and a power supply comprising a first power supply configured to generate a first operating voltage from a first voltage obtained from the chopper circuit to supply the first operating voltage to at least one of the AC-DC converter and the DC-DC converter, and a second power supply configured to generate a second operating voltage from a second voltage obtained from the chopper circuit to supply the second operating voltage to at least the cooling device of the AC-DC converter, the DC-DC converter and the cooling device, wherein:

the AC-DC converter further comprises a first control circuit configured to control the chopper circuit;

the DC-DC converter further comprises a second control circuit configured to control the DC-DC conversion circuit;

the first power supply is configured to supply the first operating voltage to the first control circuit and the second control circuit, and the first voltage is the first DC voltage; and the second power supply is configured to supply the second operating voltage to the cooling device, and the second voltage is the first DC voltage.

4. A luminaire, comprising:

a light source including at least a solid-state light-emitting device; and an electronic ballast, comprising:

an AC-DC converter comprising a chopper circuit configured to convert an AC voltage from a commercial power supply into a first DC voltage;

a DC-DC converter comprising a DC-DC conversion circuit configured to convert the first DC voltage into a second DC voltage to supply the second DC voltage to the light source;

a cooling device configured to cool the light source; and a power supply comprising a first power supply configured to generate a first operating voltage from a first voltage obtained from the chopper circuit to supply the first operating voltage to at least one of the AC-DC converter and the DC-DC converter, and a second power supply configured to generate a second operating voltage from a second voltage obtained from the chopper circuit to supply the second operating voltage to at least the cooling device of the AC-DC converter, the DC-DC converter and the cooling device, wherein:

the AC-DC converter further comprises a first control circuit configured to control the chopper circuit;

the DC-DC converter further comprises a second control circuit configured to control the DC-DC conversion circuit;

the first power supply is configured to supply the first operating voltage to the first control circuit and the second control circuit, and the first voltage is the first DC voltage; and the second power supply is configured to supply the second operating voltage to the cooling device, and the second voltage is the first DC voltage.

* * * * *